US005993291A

United States Patent [19]

Tsai et al.

[11] Patent Number: 5,993,291

[45] Date of Patent: Nov. 30, 1999

[54] SPECIMEN BLOCK PREPARATION FOR TEM ANALYSIS

[75] Inventors: Ching-Long Tsai, Taipei; Yunn-Ming Tsou, Chupei, both of Taiwan

[73] Assignee: United Microelectronics Corp., Taiwan

[21] Appl. No.: 09/074,566

[22] Filed: May 7, 1998

[30] Foreign Application Priority Data

Mar. 25, 1998 [TW] Taiwan ..... 87104444

[51] Int. Cl.[6] ..... B24B 1/00

[52] U.S. Cl. ..... 451/28; 451/31; 451/29; 451/41

[58] Field of Search ..... 451/31, 29, 41

[56] References Cited

U.S. PATENT DOCUMENTS 5,191,738 3/1993 Nakazato et al. ..... 451/41

*Primary Examiner*—David A. Scherbel

*Assistant Examiner*—Shantese McDonald

*Attorney, Agent, or Firm*—Thomas, Kayden, Horstemeyer & Risley, LLP

[57] ABSTRACT

A method for preparing a specimen block for TEM analysis that uses target point breaking of an original specimen block into two separate blocks with one block containing the point targeted for analysis. Hence, over-polishing can be avoided and polishing time is saved. Furthermore, polishing is carried out by sandwiching the specimen block between sacrificial blocks supported by polish-resistant blocks below. With the polish-resistant blocks acting as a polishing stop layer, a fixed thickness instead of variable thickness will remain after the specimen is polished.

4 Claims, 5 Drawing Sheets

SPECIMEN BLOCK PREPARATION FOR TEM ANALYSIS

CROSS-REFERENCE TO RELATED APPLICATION

This application claims the priority benefit of Taiwan application Ser. No. 87104444, filed Mar. 25, 1998, the full disclosure of which is incorporated herein by reference.

BACKGROUND OF THE INVENTION

1. Field of Invention

The present invention relates to a method of shaping a specimen block with cutting and grinding operations. More particularly, the present invention relates to a method of shaping a specimen block with cutting and grinding operations so that the specimen block is ready for observation in a transmission electron microscope (TEM).

2. Description of Related Art

In analyzing the failure of VLSI device, cross-sectional analysis of a particular target point is an effective technique. A scanning electron microscope (SEM) is a convenient tool for observing the cross-section of a target point. However, because the SEM has a poor resolution for high-density materials, the SEM is now being replaced by a transmission electron microscope (TEM) as the means of performing failure analysis ever since the semiconductor manufacturing industry has shifted towards producing more ULSI devices. As the popularity of the TEM increase, convenient methods for preparing a specimen block of suitable thickness for observation have become an important issue. A specimen must have a thickness smaller than 0.25 $\mu$m before it is transparent enough for TEM observation. Therefore, a focus on ion beam (FIB) method has been developed for removing additional material from the cutout block so that a very thin section is obtained. FIG. 1 shows the ultimate shape of a specimen for TEM observation after a series of preparatory steps. The method of preparation includes first cutting out a specimen block 100 from a marked portion of the wafer. The specimen block 100 has a thickness d of about 30 $\mu$m. Next, the specimen block 100 is further ground in a top-down direction 102 using a focused ion beam so that the marked portion 104 of the specimen has a very thin section. Now, the marked section 104 can be observed using a TEM from a direction 106.

FIGS. 2A through 2G are a series of views showing a conventional method of preparing a specimen block, wherein the cross-mark contains a portion of the defective device that needs to be observed by a TEM. First, as shown in FIG. 2A, a laser is used to form a mark 202 locating the position of a failed device on a specimen block 200. The mark 202 is the so-called target point 202. Next, the specimen block 200 is ground, starting from one end 204 of the specimen block 200. The grinding only stops when the surface has come within 30 $\mu$m of the target point 202 as shown in FIG. 2B. Due the lack of any labels for assessing distance from the target point, the grinding machine has to be stopped frequently, especially near the end of the grinding operation. Therefore, if one is not careful enough, over-grinding can easily occur leading to destruction of the target point 202.

Next, as shown in FIG. 2C, the final specimen block 200 as shown in FIG. 2B is placed on a jig 206. The jig 206 is made by attaching the backs of two unwanted wafer chips 206*a* and 206*b* together. The specimen block 200 is placed on the exposed surface of the wafer chip 206*a*. The location of the target point 202 must not be too far away from the end 204 as shown in FIGS. 2B and 2D so as to avoid the possibility of breaking the target point 202. Next, as show in FIG. 2E, the specimen block 200 and the wafer chip 206*a* are simultaneously ground in a direction 207 so that a portion of the unwanted specimen block 200 is removed. The wafer chip 206*a* of the jig is a sacrificial material. Finally, a specimen block 200 having a thickness of about 30 $\mu$m is obtained. Thereafter, the specimen block 200 is placed on a copper grid 208 as shown in FIG. 2F, and then the copper grid 208 is placed on a base block 210 as shown in FIG. 2G. The specimen block 200 is further ground by a focused ion beam 212 so that the target point 202 becomes a very thin section similar to the one shown in FIG. 1. Now, the specimen block 200 is ready for observation by a TEM from direction 214.

In the above procedure of cutting and grinding to obtain a specimen block, over-polishing of the specimen can easily happen, resulting in a damaged target point. This is because polishing thickness is difficult to control. On the other hand, if the specimen block is only polished a little to avoid damaging the target point, the specimen block will be too thick for the focused ion beam to operate. Therefore, the processing time for the focused ion beam will be considerable.

In light of the foregoing, there is a need to improve the method of preparing specimen blocks.

SUMMARY OF THE INVENTION

Accordingly, the present invention is to provide a method of preparing a specimen block. The method is to break an original specimen block into two separate blocks so that the target point is near the edge of a broken surface in one of the resultant blocks. Hence, over-polishing in a conventional method is avoided and much time is saved in specimen block preparation. In addition, the specimen block is sandwiched between sacrificial blocks with polish-resistant blocks supported from below. The polish-resistant blocks provide a polishing end layer for the specimen block polishing operation. Hence, a constant thickness of the specimen block from the target point can be maintained.

To achieve these and other advantages and in accordance with the purpose of the invention, as embodied and broadly described herein, the invention provides a method for preparing a specimen block for a target point. The method comprises the steps of breaking a first specimen block having a target point into a second specimen block and a third specimen block. Each has a broken surface, the second specimen block contains the target point, and the distance between the broken surface and the target point can be controlled within a limit. Next, a supporting base is provided, and then two blocks made from a polish-resistant material with each block having the same thickness are placed on top of the supporting block. Thereafter, the second specimen block is placed in between the two blocks with its broken surface in contact with the supporting base. Another two blocks made from a sacrificial material are then placed on top of each polish-resistant block, wherein the sacrificial and the polish-resistant blocks are made from different materials. Finally, the specimen block and the two sacrificial blocks are simultaneously polished using the two polish-resistant blocks as a polishing end layer. Since the polish-resistant blocks have a definite thickness, the final thickness of the specimen block after the polishing operation will remain constant.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
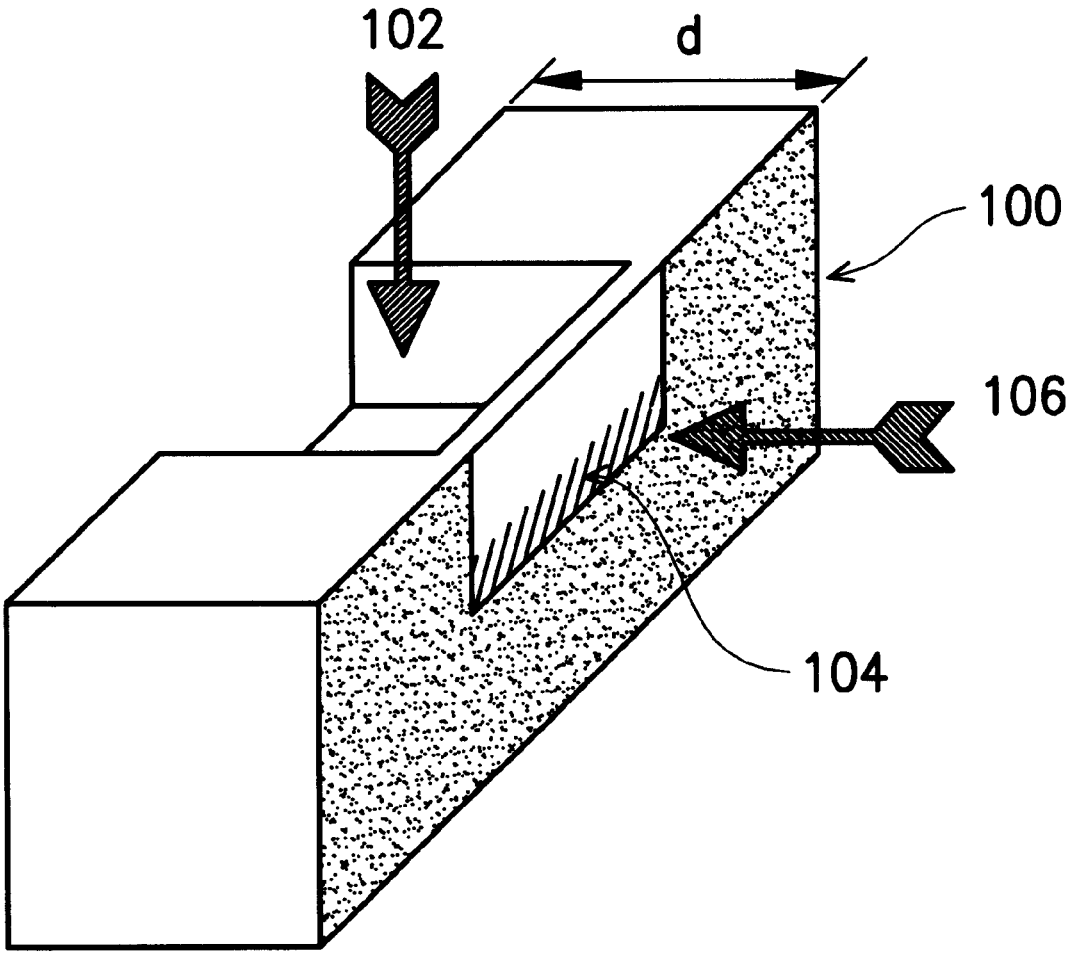
FIG. 1 (PRIOR ART)
FIG. 1 shows the ultimate shape of a specimen for TEM observation after a series of preparatory steps.
Figure 2A:
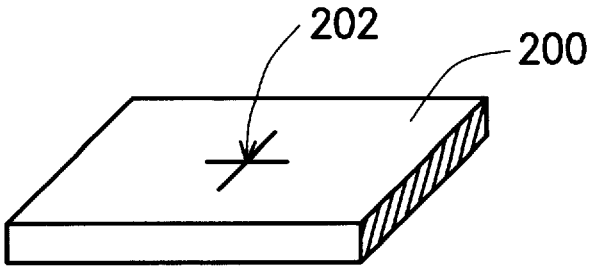
FIG. 2A (PRIOR ART)
FIG. 2A is a perspective view, illustrating a specimen block with a mark.
Figure 2B:
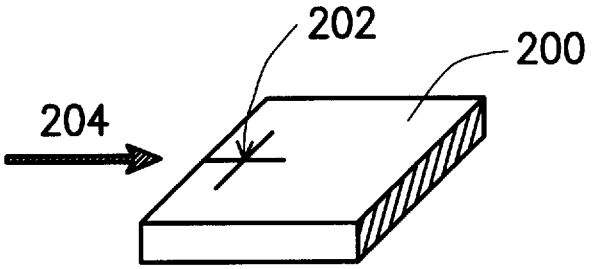
FIG. 2B (PRIOR ART)
FIG. 2B is a perspective view, illustrating a ground specimen block.
Figure 2C:
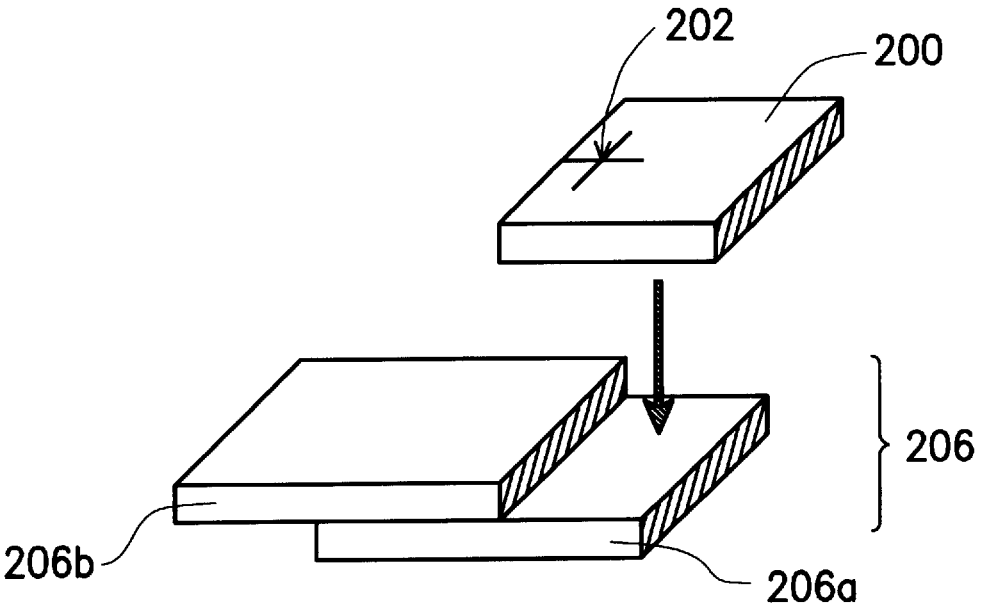
FIG. 2C (PRIOR ART)
FIG. 2C is a perspective view, illustrating a method step of mounting the ground specimen block on a jig.
Figure 2D:
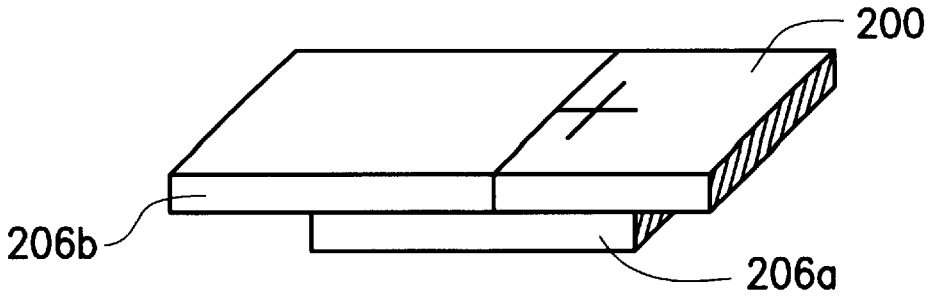
FIG. 2D (PRIOR ART)
FIG. 2D is a perspective view, illustrating a structure of the ground specimen block, after being mounted on the jig.
Figure 2E:
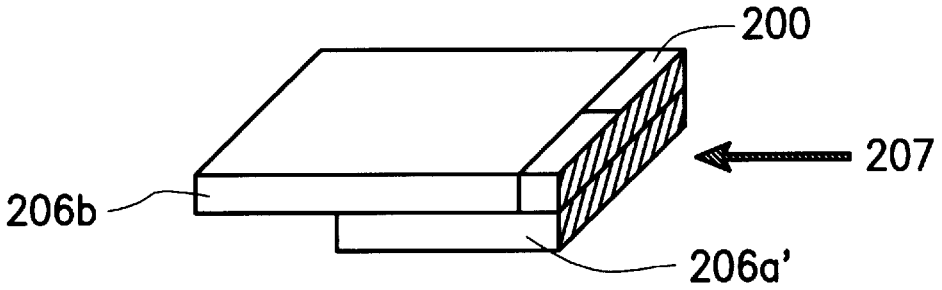
FIG. 2E (PRIOR ART)
FIG. 2E is a perspective view, illustrating a ground structure of the jig with the ground specimen block of FIG. 2D.
Figure 2F:
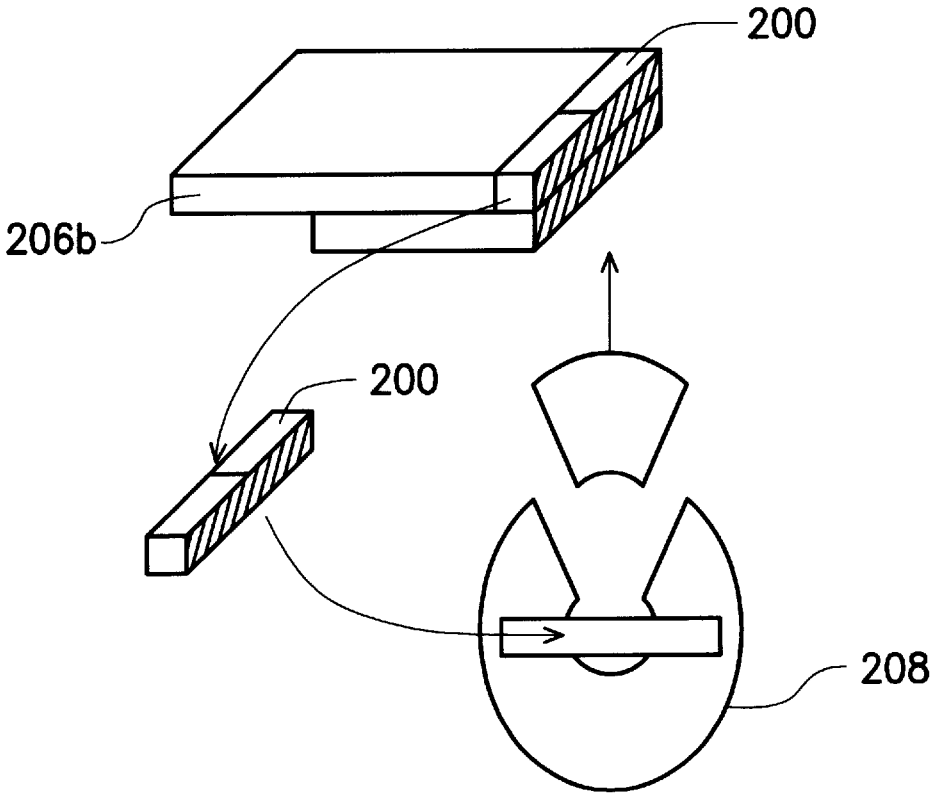
FIG. 2F (PRIOR ART)
FIG. 2F is a perspective view, illustrating a method step of placing the specimen block on a copper grid.
Figure 2G:
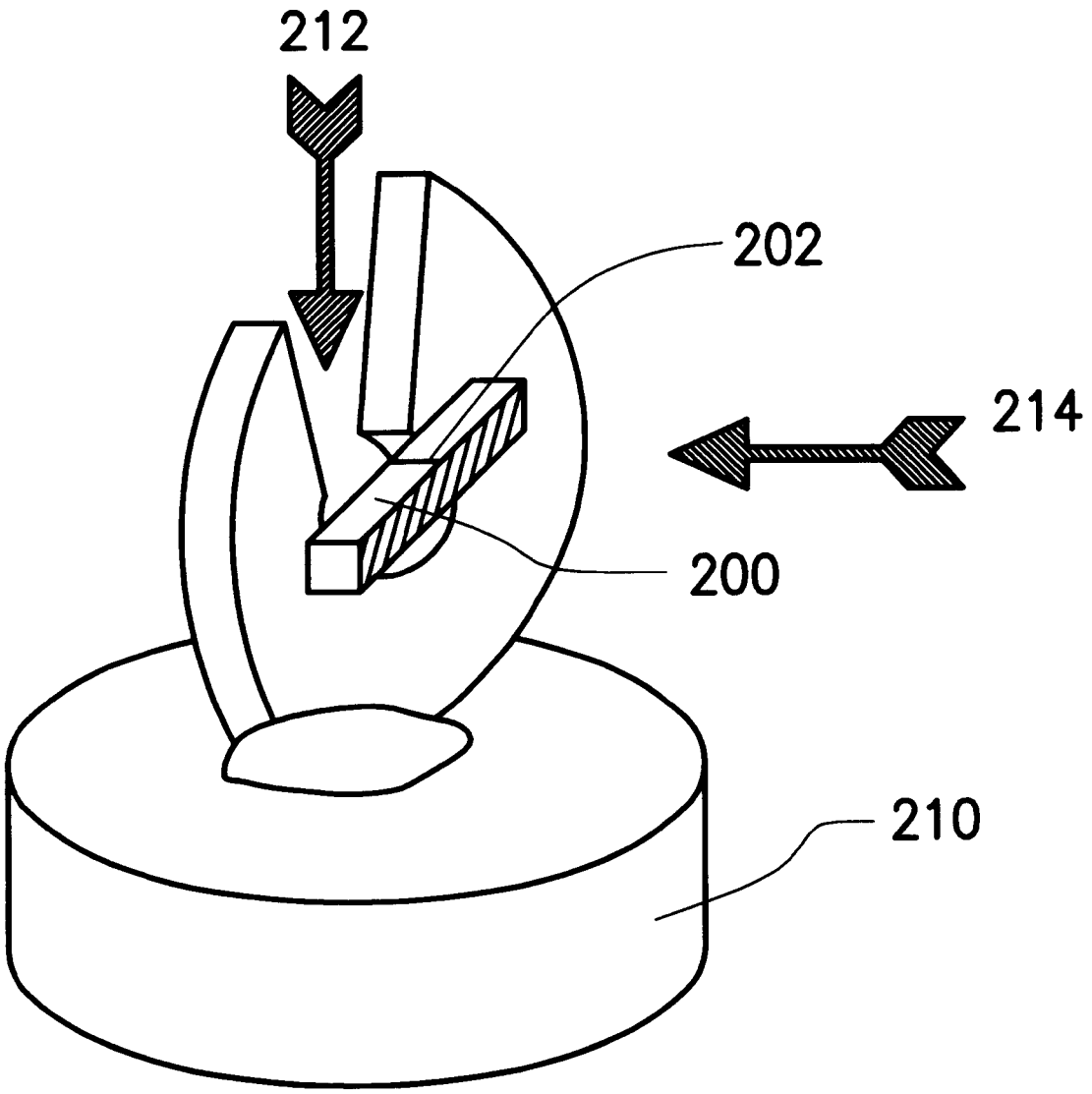
FIG. 2G (PRIOR ART)
FIG. 2G is perspective view, illustrating a placement of the copper grid on a base block for grinding by a focused ion beam.

Detailed reference will now be made to the present preferred embodiments of the invention, examples of which are illustrated in the accompanying drawings. Wherever possible, the same reference numbers are used in the drawings and the description to refer to the same or like parts.

Figure 3A:
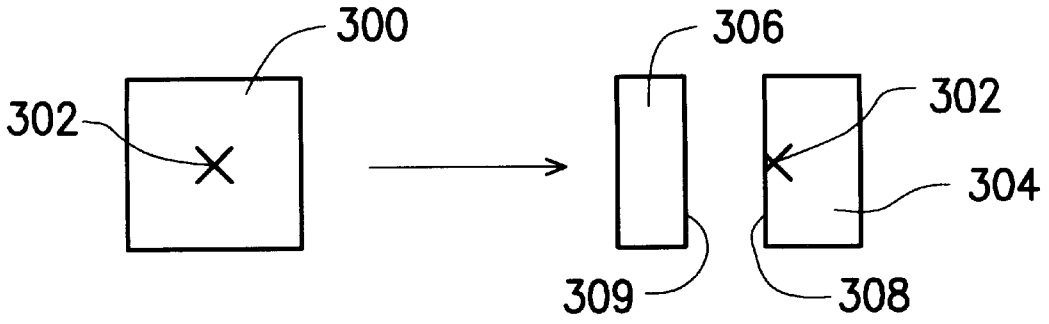
FIG. 3A is top view, illustrating how a specimen block with mark is broken into two pieces, according to the preferred embodiment of the invention.
Figure 3B:
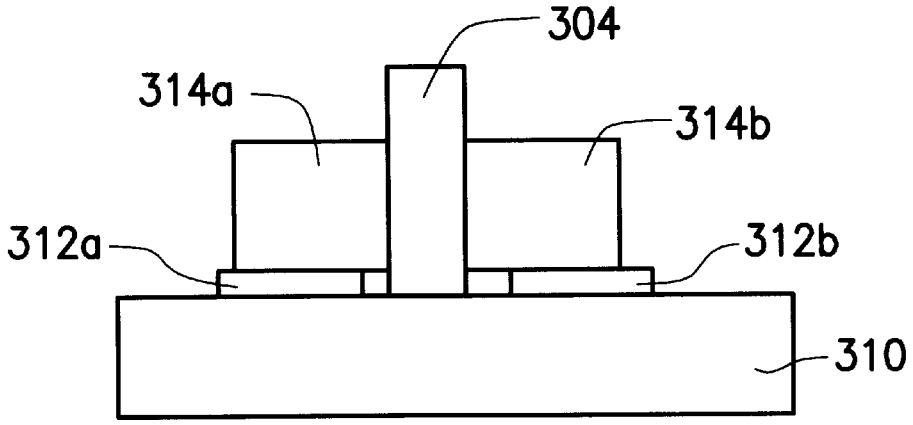
FIG. 3B is a cross-sectional view, illustrating how the specimen block is secured on a supporting base, according to the preferred embodiment of the invention.
Figure 3C:
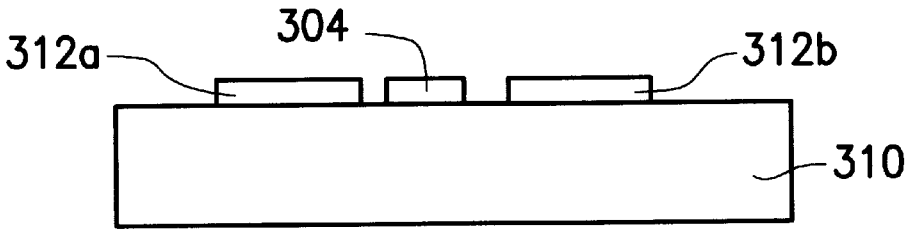
FIG. 3C is a cross-sectional view, illustrating a final specimen block after grinding, according to the preferred embodiment of the invention.

FIGS. 3A through 3C are a series of views showing the method of preparing a specimen block according to one preferred embodiment of this invention.

First, as shown in FIG. 3A, a first specimen block 300 having a target point 302 is marked using, for example, a laser. The target point 302 should include the defective portion of a device where observation is desired. In this invention, a point breaking method is used to break the first specimen block 300 into a second specimen block 304 and a third specimen block 306. The second specimen block 304 and the third specimen block 306 each have a broken surface 308 and 309 respectively. The target point 302 now resides in the second specimen block 304. Distance between the target point 302 and the broken surface 308 can be carefully controlled so that they are within 5 $\mu$m of each other.

Next, as shown in FIG. 3B, a supporting base 310 is provided. Then, two blocks 312*a* and 312*b* made from a polish-resistant material and having a pre-defined thickness are placed on top of the supporting base 310. Thereafter, the second specimen block 304 is inserted between the blocks 312*a* and 312*b*, so that the broken surface 308 is in contact with the supporting base 310. Subsequently, another two blocks 314*a* and 314*b*, made from a sacrificial material, are placed above the blocks 312*a* and 312*b* respectively so that the specimen block 304 is sandwiched in the middle.

Next, as shown in FIG. 3C, using the polish-resistant blocks 312*a* and 312*b* as a polishing stop layer, the sacrificial blocks 314*a*, 314*b* and the specimen block 304 are simultaneously polished. Since the material for forming the polish-resistant blocks 312*a*, 312*b* is different from the material for forming the sacrificial blocks 314*a*, 314*b*, the moment when the polish-resistant blocks 312*a* and 312*b* are reached is easily detected. Because the polish-resistant blocks 312*a*, 312*b* have a pre-defined thickness, the resulting second specimen block 304 after polishing will have a constant thickness as well. Therefore, over-polishing of specimen block can be avoided.

Finally, a focused ion beam is used to remove a portion of the material around the target point so that analysis of the specimen block can be carried out using a TEM. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for preparing a specimen block comprising the steps of:

providing a first specimen block that contains a target point;

breaking the first specimen block into two blocks, including a desired second specimen block and a discardable third specimen block, the second and third specimen blocks each having a broken surface, wherein the second specimen block contains the target point, and the distance between the target point and the broken surface can be controlled within a set limit;

placing two polish-resistant blocks having a pre-defined thickness on a supporting base, then placing the second specimen block, with its broken surface down, on the supporting base between the polish-resistant blocks, and finally putting two sacrificial blocks on top of the polish-resistant blocks, sandwiching the second specimen block therebetween; and polishing the sacrificial blocks and the second specimen block together, using the polish-resistant blocks as a polishing stop layer, to obtain a specimen block having a fixed thickness, determined by a thickness of the polish-resistant blocks, wherein the sacrificial blocks and the polish-resistant blocks are made from different materials and the sacrificial blocks are more easily polished than the polish-resistant blocks.

2. The method of claim 1, wherein the pre-defined thickness of the polish-resistant blocks is the required thickness of the specimen block.

3. The method of claim 1, wherein the distance between the broken surface and the target point of the second specimen block can be controlled within a 5 $\mu$m limit.

4. A method for preparing a specimen block comprising the steps of:

providing a first specimen block that contains a target point;

removing a portion of the specimen block so that the specimen block has the target point near to a first edge of the portion;

holding the specimen with two sacrificial blocks;

disposing the first edge toward a supporting base and spacing the sacrificial blocks away from the supporting base with a polish-resistant pad that has a predetermined thickness;

polishing the sacrificial blocks and the specimen block from a second edge opposite the first edge, using the polishing-resistant pad as a polishing stop point.

* * * * *